US006158608A

United States Patent [19]

Schlattl

[11] Patent Number: 6,158,608

[45] Date of Patent: Dec. 12, 2000

[54] CONTAINER, IN PARTICULAR A DRINKS CAN, AND LID FOR SUCH A CONTAINER

[75] Inventor: Werner Schlattl, Ruderting, Germany

[73] Assignee: Cetoni Umwelttechnologie Entwicklungsgesellschaft mbH, Germany

[21] Appl. No.: 09/147,827

[22] PCT Filed: Sep. 13, 1997

[86] PCT No.: PCT/DE97/02062

§ 371 Date: May 17, 1999

§ 102(e) Date: May 17, 1999

[87] PCT Pub. No.: WO98/12118

PCT Pub. Date: Mar. 26, 1998

[30] Foreign Application Priority Data

| | | | |
|---|---|---|---|
| Sep. 18, 1996 | [DE] | Germany | 296 16 133 |
| Oct. 12, 1996 | [DE] | Germany | 196 41 155 |
| Oct. 22, 1996 | [DE] | Germany | 196 43 487 |

[51] Int. Cl.[7] ..... B65D 51/18

[52] U.S. Cl. ..... 220/253; 220/258; 220/269

[58] Field of Search ..... 220/253, 256, 220/258, 259, 269

[56] References Cited

U.S. PATENT DOCUMENTS

| | | | |
|---|---|---|---|
| 3,933,270 | 1/1976 | Bozek . | |
| 4,008,823 | 2/1977 | Tarro . | |
| 4,717,039 | 1/1988 | Ayyoubi . | |
| 4,880,136 | 11/1989 | Englert | 220/253 |
| 5,080,249 | 1/1992 | Shock . | |
| 5,129,773 | 7/1992 | Shock . | |
| 5,205,430 | 4/1993 | Valyi | 220/253 X |
| 5,692,633 | 12/1997 | Gordon | 220/253 |

FOREIGN PATENT DOCUMENTS 44 27 812 A1 2/1996 Germany .

*Primary Examiner*—Stephen K. Cronin
*Attorney, Agent, or Firm*—Hoffman Wasson & Gitler

[57] ABSTRACT

A beverage can lid which has a sealing tab on its surface so that the can can be resealed after it has been opened. The can contains a rotatable lid element in addition to a fixed lid element either above or below the fixed element to perform the sealing feature.

21 Claims, 13 Drawing Sheets

CONTAINER, IN PARTICULAR A DRINKS CAN, AND LID FOR SUCH A CONTAINER

BACKGROUND OF THE INVENTION

The invention pertains to a container, and more particularly, a beverage can. Furthermore, the invention pertains to a container lid or container seal.

Beverage cans with a can body made of metal, for example, an aluminum alloy, and having a can lid, which is also made of metal, and forming a sealing tab on the surface of the lid that can either be pulled out of the lid, or pushed into the interior of the can in order to open the can, are known and widely used. The disadvantage of this type of can is that after opening such a container, it cannot be re-closed for further consumption of the contents of the container (working seal).

It is an object of the present invention to improve a container, or a container seal, of the type mentioned above, in such a way that a convenient and tight working seal is achieved, without the necessity of the user having to use additional elements not already present on the lid.

SUMMARY OF THE INVENTION

In order to solve this problem a container and a container lid or seal is provided.

Due to the rotatable lid element the container can be sealed effectively even after the first opening. In one embodiment of the invention, the rotatable lid element is located, seen from the top of the lid, above the lid element that is affixed to the body of the can, whereby the bases of both lid elements are adjacent to one another. In another possible embodiment of the invention, the rotatable lid element is located beneath the lid element and is affixed to the body of the can in the interior of the body of the container. In this embodiment, the bases of the two lid elements are likewise adjacent to one another. In all preferred embodiments, it is intended that the perimeter of the respective rotatable lid element has a positive fit, while being able to be rotated in the lid element that is affixed to the body of the container, so as to prevent the two lid elements from lifting off of each other on the perimeter, so that a tight sealing of the container aperture is achieved, especially for the working seal.

DESCRIPTION OF THE DRAWINGS

In the following, the invention is described in more detail with examples of embodiments with reference to the figures, which depict.

DETAILED DESCRIPTION OF THE INVENTION

Figure 1:
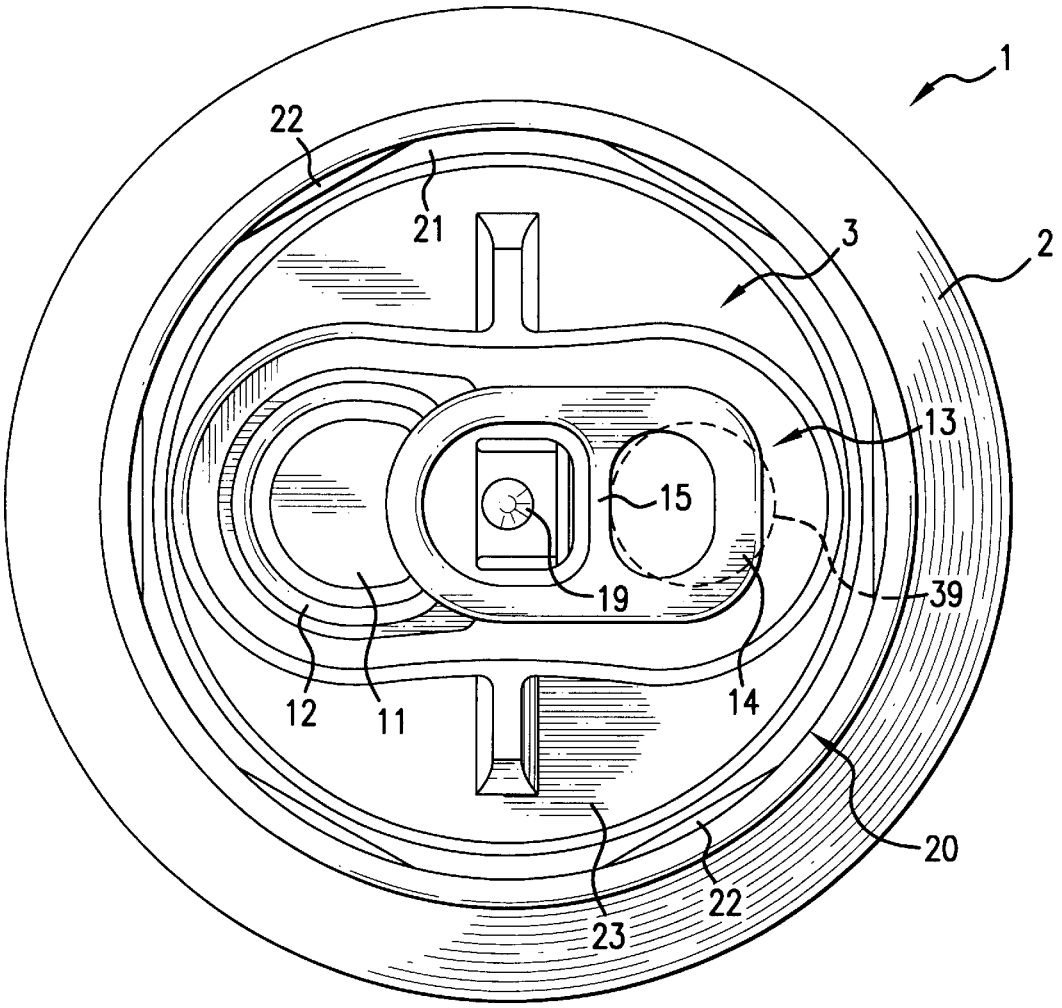
FIG. 1 is a simplified depiction in top view of a beverage can with the original seal intact.

In the figures, there is a beverage can 1 that is intended for soft drinks, for example, and has a body 2 made of metal, for example an aluminum or aluminum alloy, that is manufactured by deep drawing. The can 1 has a sealed peripheral wall and a sealed bottom. On the top, the open can body 2 is sealed by a can lid 3 that is affixed in the customary manner and with the customary means by a lock seam 4 along one rim of the can with the can body 2, that hermetically seals the interior 5 of the beverage can to the outside.

The can lid 3 has a lid element 6, that is preferably manufactured from a sheet of aluminum, or aluminum alloy, by deep-drawing; a base 7 and a rim 8 that extends upward beyond the top of the base 7 and has an essentially circular ring shape and concentrically encompasses the middle axis M of container and lid and which is affixed to the can body 2 or with the rim 8 that encompasses the aperture of the can body by means of the lock seam 4. At the transition to the rim 8, a snap ring groove 9 that encompasses the middle axis M of the can lid in a circular ring shape, is molded into the base 7 and is open on the upper side of the lid base 7, i.e. has its concave side there. Connected to the snap ring groove 9, and across from this in relation to the middle axis M and displaced radially inward, the lid base 7 likewise has a ring lip 10, that concentrically encompasses the middle axis M, and that is arched convexly on the top of the lid base 7.

Figure 4:
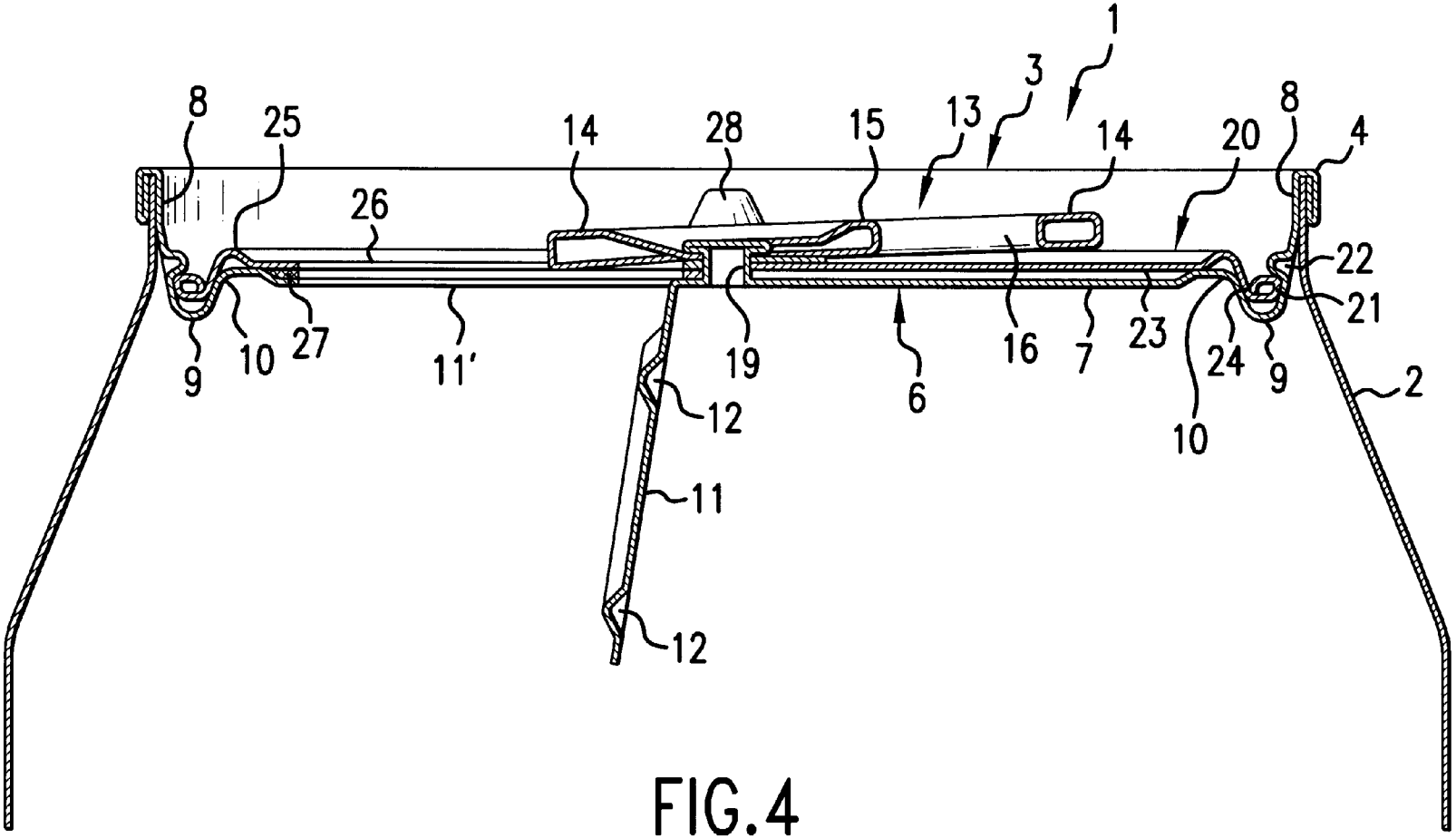
FIGS. 4 and 5 are a sectional view of the upper part of the opened beverage can (FIG. 4) and of the closed beverage can for further use or consumption.
Figure 5:
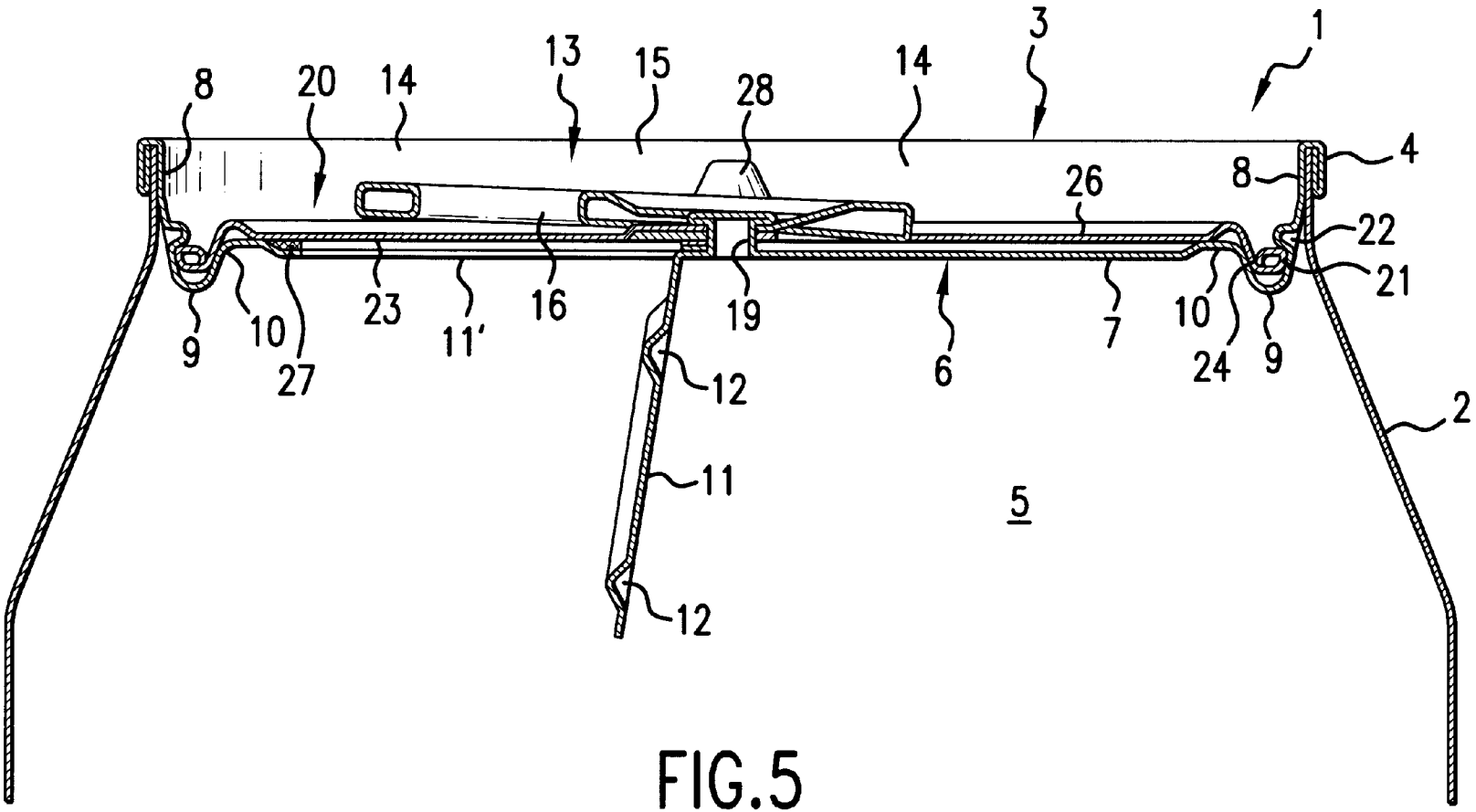

In the lid base 7, which is essentially of circular disk shape, there is a sealing tab 11, that is radially displaced to the middle axis M, that can be pushed inward in the usual manner in order to open the beverage can, or the can lid 3, in such a way that this tab 11, when the can is open, is still partially connected with the lid base 7, in the interior 5 of the can, for freeing an aperture 11, as illustrated in FIGS. 4 and 5.

The tab 11 is manufactured of one piece with the lid element 6, or with its base 7, in that the rim line of this tab 11 is formed at least partially from a breaking line on which the material of the lid base is reduced in cross section. The tab 11 is reinforced by means of a self-contained enforcement lip 12, of circular ring shape, that extends beyond the surface of the tab 11, or beyond the top of the base 7.

Figure 3:
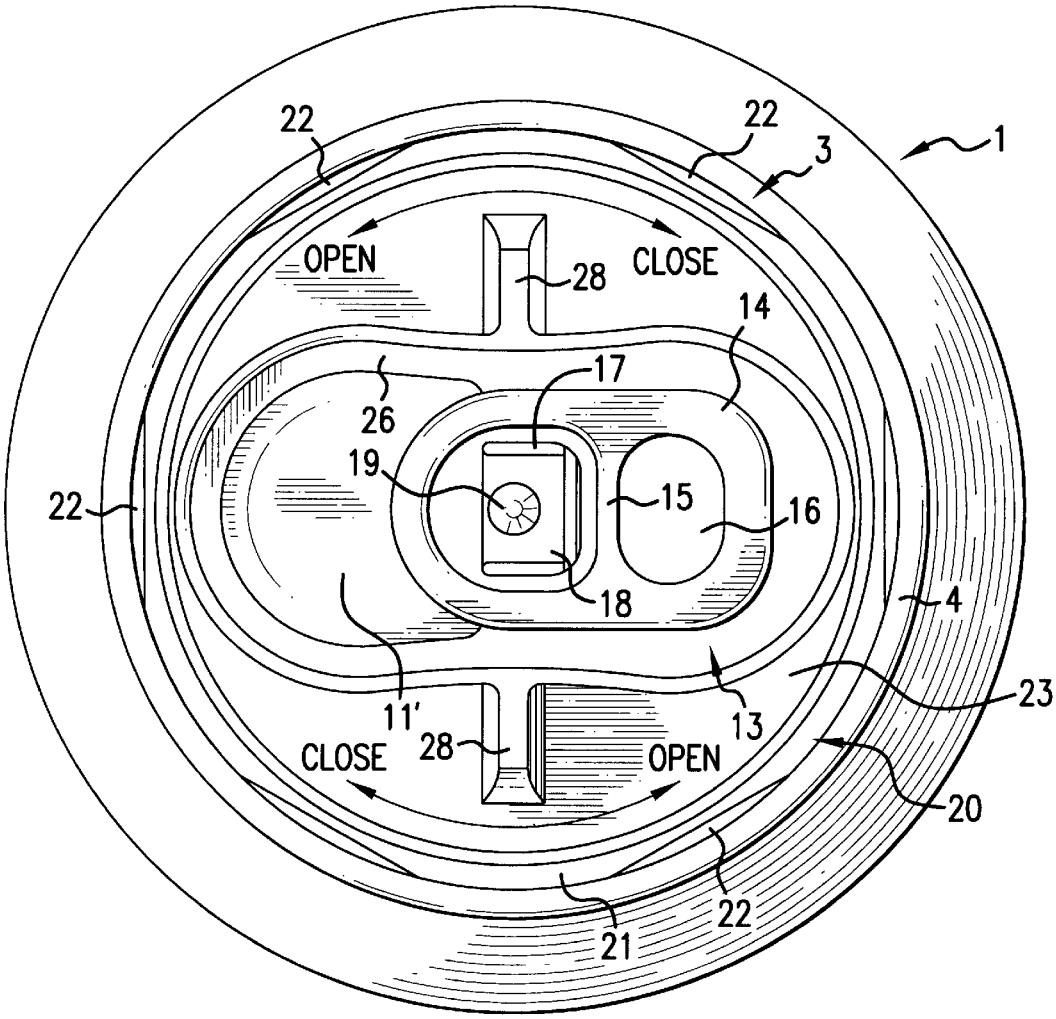
FIG. 3 is a top view of the opened can.

In order to open the beverage can 1, i.e. to pull up and bend the tab 11 inward, a pull-ring 13 is provided on the top of the can lid 3, that is formed in the usual manner in the top view of FIGS. 1 and 3, as an oval ring 14 with a middle stay 15, and two ring apertures 16 and 17 on either side of the middle stay 15. A tab 18 by which the pull ring 13 is fastened, to the top of the lid element 6, in the vicinity of the middle axis M, by means of a rivet-like fastener 19 that is formed from the material of the lid base 7 extends into the ring aperture 17, which is closer to the sealing tab 11, than the ring aperture 16. The ring body 14 and the middle stay 15 are stationary. The tab 18 can be bent. The pull ring or its ring body 14 lies against the pull tab 11, or the lip 12, on the side away from the ring aperture 16. On a can with the original seal intact the plane of the pull ring lies parallel or nearly parallel to the plane of the lid base, within the space encompassed by the rim 8, i.e. below the upper lip of the beverage can 1 formed by the lock seam 4.

A further lid element 20, on the fastener 19, between the can base 7 and the tab 18, is provided for that can rotate around -he middle axis M. This lid element 20 is of circular disk shape in the depicted embodiment and has a rolled-in, closed rim lip 21 that encompasses the middle axis M in the manner of a ring. The lid element 20 is guided in the snap ring groove 9 with the closed, rolled-in rim lip 21. In several areas around the middle axis M, i.e. in the depicted embodiment in six areas surrounding the middle axis M, cams 22 are pressed into the rim 8, extending beyond the inner side of the rim facing the base 7 and holding the rim 21 in the snap ring groove 9.

In the depicted embodiment, the lid element 20 is slightly bowl-shaped, and it has a base 23 of essentially circular disk shape, a ring-shaped rim 24 that extends diagonally downward into the snap ring groove 9 encircling the middle axis M and has a rim lip 21. At the joining of the rim 24 and the base 23, there is a ring lip 25 that encompasses the middle axis M, giving the lid element 20 additional stiffness. Across from the middle axis M, radially displaced, in the base 23 of the lid element 20 an aperture 26 is provided for that has at least the same dimensions as the sealing tab 11, or the drinking or pouring aperture 11' after pressing in this sealing tab. In a can 1, with the original seal intact, the aperture 26 is congruent with the sealing tab 11. The lip 12 is located within the aperture 26 and extends into this aperture 26 so that rotation of the lid element 20 in relation to the lid element 6 is not possible.

Furthermore, a self-enclosed ring-shaped seal 27 that encompasses the sealing tab 11 or the aperture 11' on its lip is provided for on the upper side of the lid element 6, or the lid base 7, between the latter and the base 23.

At the joining of the lid base 23 and the ring lip 25, the bottom side of the lid base 23 lies against the ring lip 10 of the lid base 7. This causes a gap to be formed between the two lid bases 7 and 23, the width of which is approximately the same as the thickness of the elastic seal 27 stretched between the two bases 7 and 23, i.e. the pressure of the lid base 23 against the ring lip 10 also prevents the seal 27, by means of corresponding riveting in the vicinity of the fastener 19 from being deformed too strongly and thus damaged.

On the lid base 23, two carriers 28 that extend beyond the top of the lid base are also provided for. All components of the lid element 20, and the lid element 6, are manufactured from a single sheet of metal by punching and molding. The pull ring 13, as well as all parts of the lid element 26, are formed and arranged in such a way that there is sufficient free space on the inner side of the can lid 3, to process it with the usual machines for sealing of the can body 2.

Figure 2:
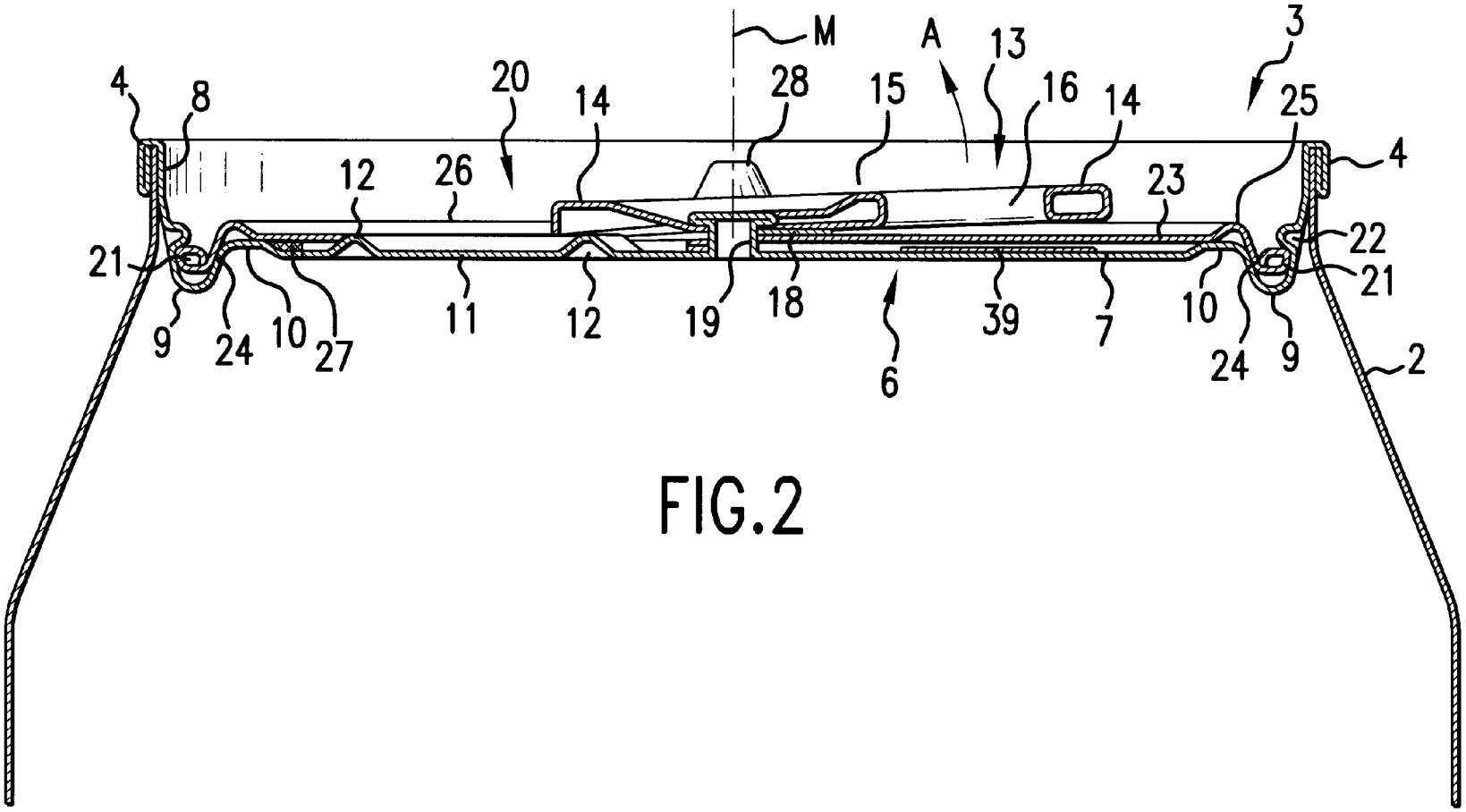
FIG. 2 is a sectional view of the upper part of the beverage can through the can seal there with the original seal intact.
Figure 6:
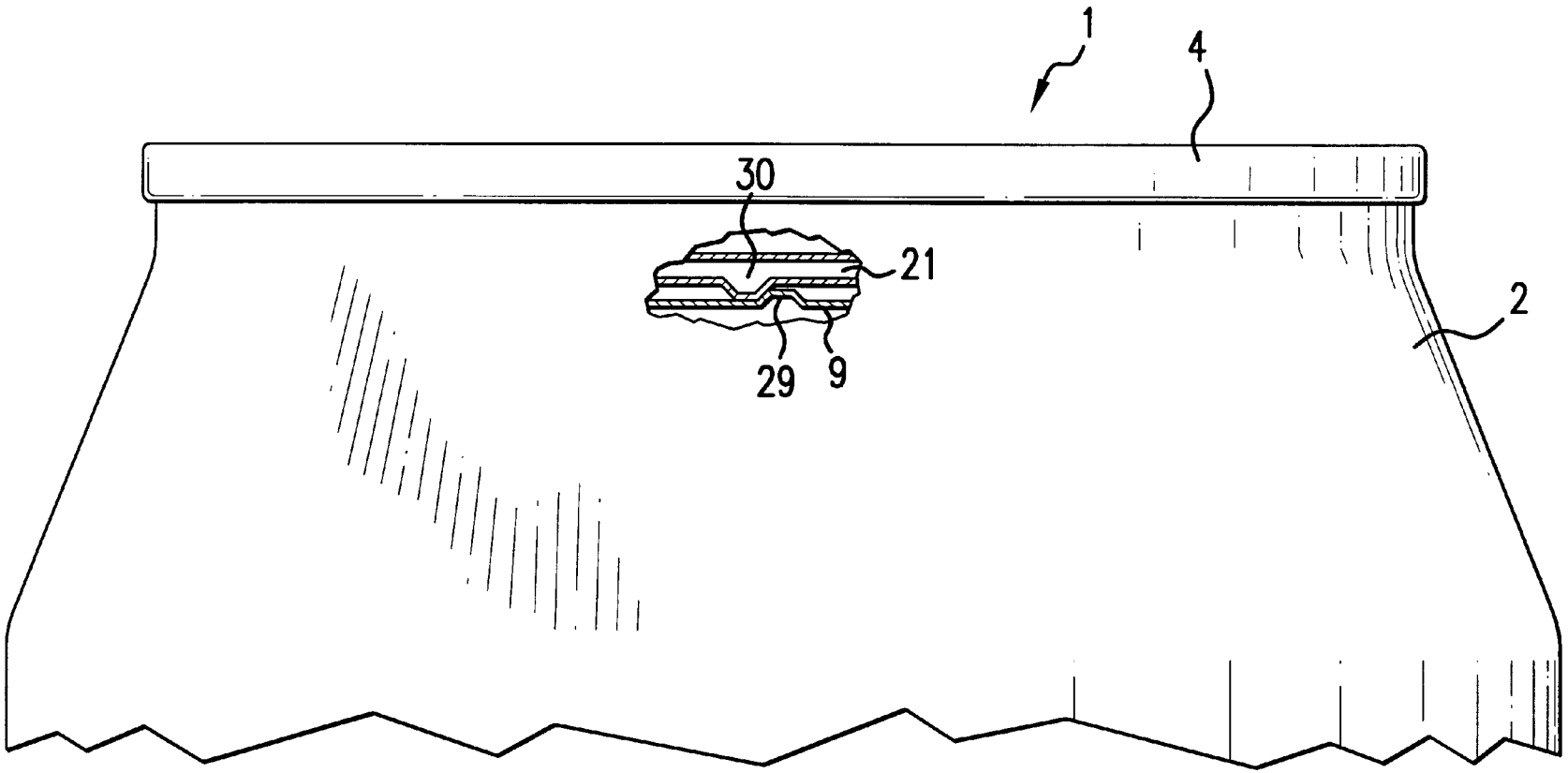
FIG. 6 is the beverage can of FIGS. 1–5 in side view, and partially in sectional view.

FIGS. 1 and 2 show the beverage can 1 with the original seal intact. In order to open the beverage can 1, the pull ring 13 is lifted on the side opposite its sealing tab 11 corresponding to the arrow A in FIG. 2, whereby the other side of the pull ring comes into position against the sealing tab 11, or against the lip 12 there, causing the sealing tab 11 to be pushed inward, creating the aperture 11' (FIG. 4). The contents of the beverage can 1 can then be poured or drank through the apertures 11 and 26, which are now congruent. The beverage can 1 can be sealed during consumption. In order to do this, the lid element 20 is rotated on the carriers 28 around the middle axis M far enough that the aperture 26 is located outside of the aperture 11 and the latter is covered by the lid base 23, as depicted in FIG. 5. In the depicted embodiment, the lid element 20 is intended to be turned 180°. The two end positions are determined by means of stops 29 and 30 (FIG. 6) in the snap ring groove and on the rim or the ring lip 21. Turning of the lid element 20 for closing and opening the aperture 11 takes place on the carriers 28. In the depicted embodiment the pull ring 13 is connected with the lid element 20 in such a way that it cannot be turned, in that the rectangular-shaped tab 18 fits into a depression in the lid base 23 corresponding to this tab. By means of the seal 27 a tight working seal is achieved, especially since the lid element 20 is guided firmly at its perimeter by the cams 22 in the snap ring groove 9 and is prevented by the cams 22 pressed against the rim lip 21 from unwanted lifting on the rim, so that even with carbonated beverages or beverages under pressure there is no danger of a lifting of the working seal.

Figure 7:
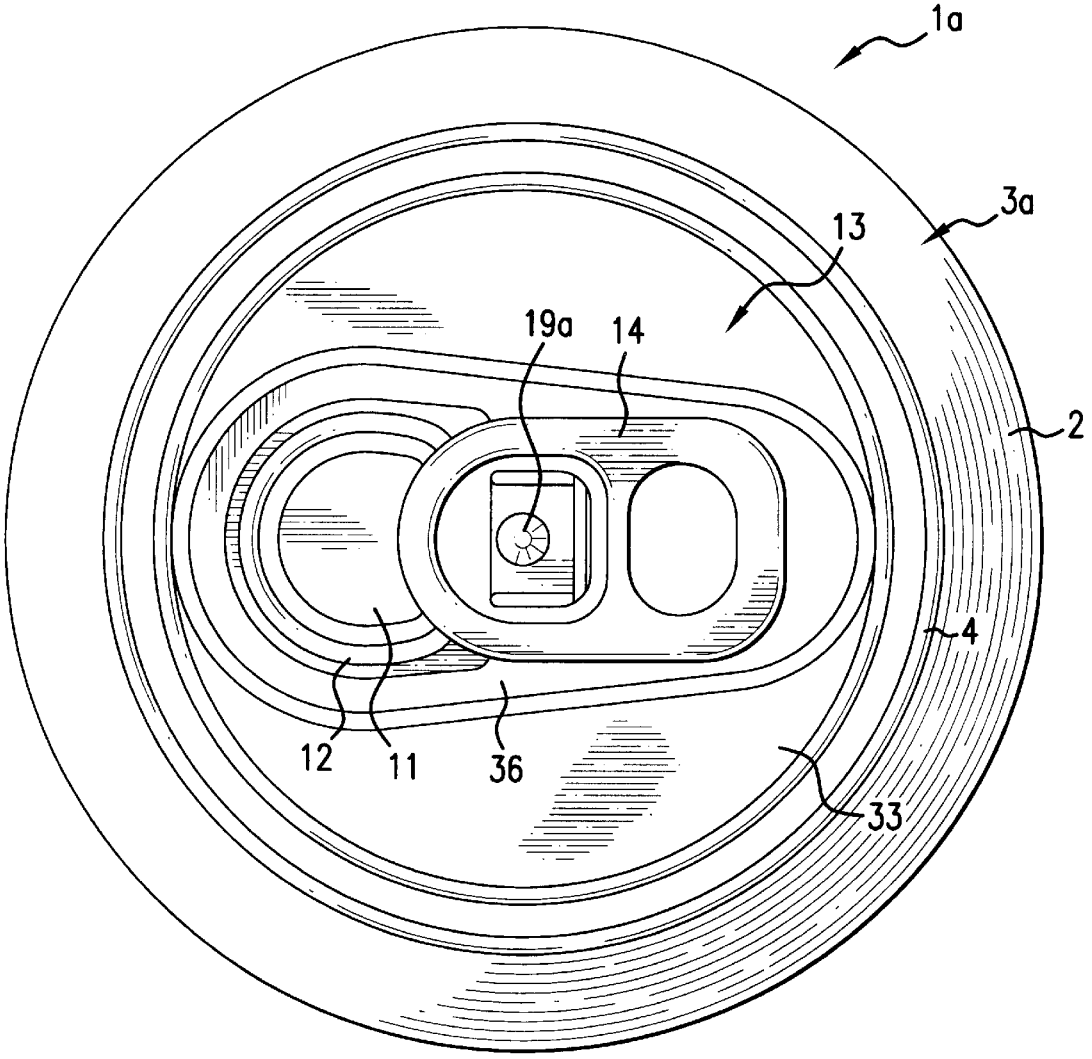
FIG. 7 is a top view of a second embodiment of the can according to the present invention in its original, sealed condition.

FIG. 7 shows a beverage can la that has a can body 2 and a can lid 3*a* sealing the can on the top, which differs essentially from the can lid 3, in that the lid element 31 affixed to the body of the can is the upper lid element and the rotatable lid element 32 for the working seal is the lower lid element, i.e. located in the interior 5 of the beverage can.

The lid element 31 is again bowl-like with a lid base 33, of essentially circular disk shape, and has a lid rim 34 that is affixed to the rim of the can body 2 by means of a lock seam. At the joining of the lid base 33, and the rim 34, a ring lip 35 is provided for on the lid element 31 that encompasses the middle axis M and extends into the interior 5, i.e. beyond the bottom side of the base 33 and encircling the middle axis M. The lid element 31 also has an aperture 26 on the base 33 corresponding to the aperture 36.

With the help of this rivet-like fastener 19*a*, formed from the material of the lid element 32, the pull ring 13 is attached to the upper side of the base 33. In the depicted embodiment, the fastener 19*a* has a non-circular cross-section, for example a rectangular or square cross section. In the tab 18 of the pull ring 13, an aperture adjusted to this cross section is provided for, so that by turning the pull tab 13 on the middle axis M, the lid element 32 is also turned. With the fastener 19*a*, the lid element 32 is pivoted in the middle of the lid element 31, so that it can rotate.

The circular ring-shaped rim of the lid element 32 is formed in such a way that it encompasses the ring lip 35 there with a positive fit, but also forming at the same time a guide for the lid element 32 when revolving on the middle axis M. In the base 38 of the lid element 32, the sealing tab 11 is formed with the lip 12 that, with the original seal of the beverage can la intact, extends into the aperture 36, thus preventing the lid element 32 from turning in relation to the lid element 31 on the middle axis M. On the upper side of the base 38, the seal 27, encompassing the sealing tab 11, is again provided for.

Figure 8:
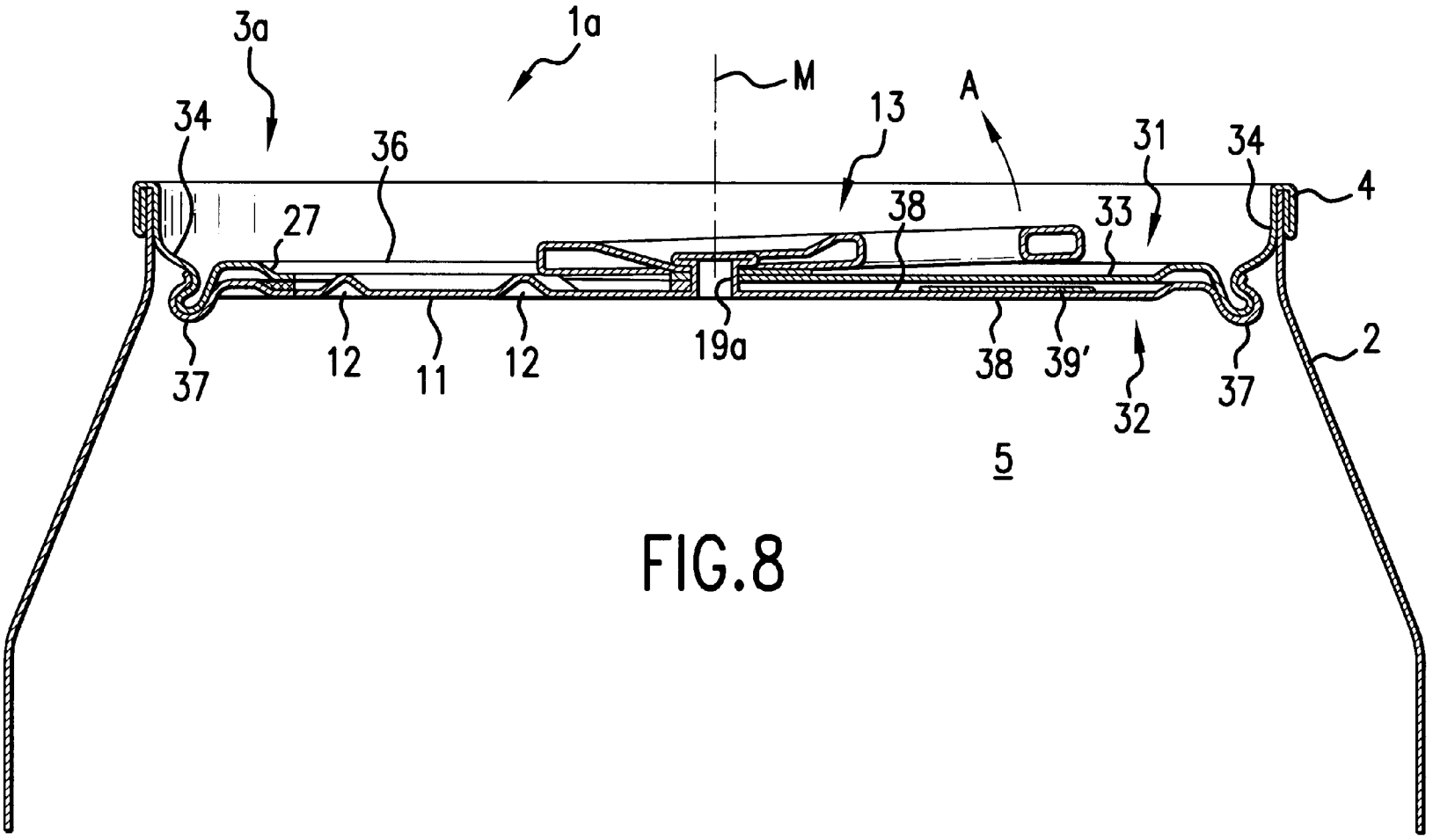
FIG. 8 is a sectional view through the can in FIG. 7.
Figure 9:
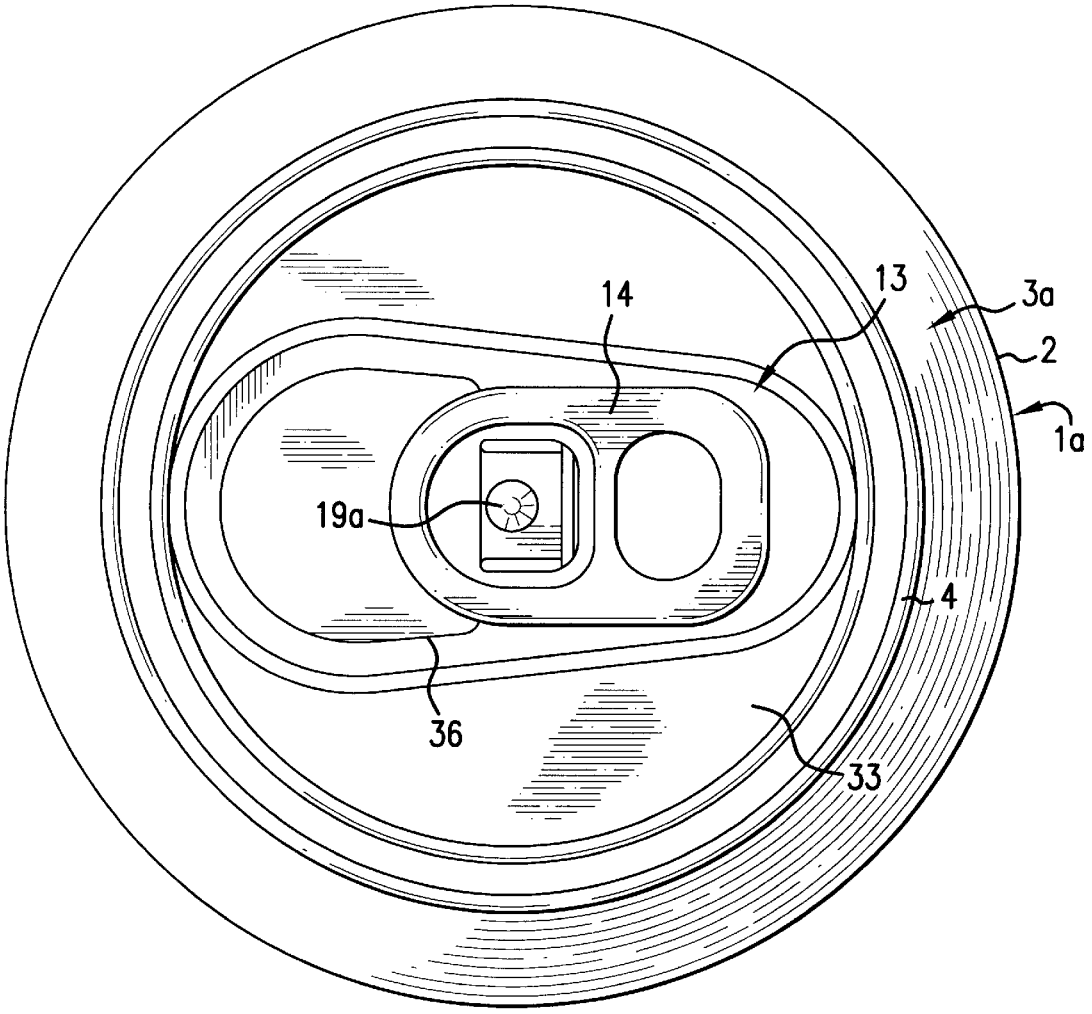
FIG. 9 is a top view of the can in FIG. 7, however in opened condition.
Figure 10:
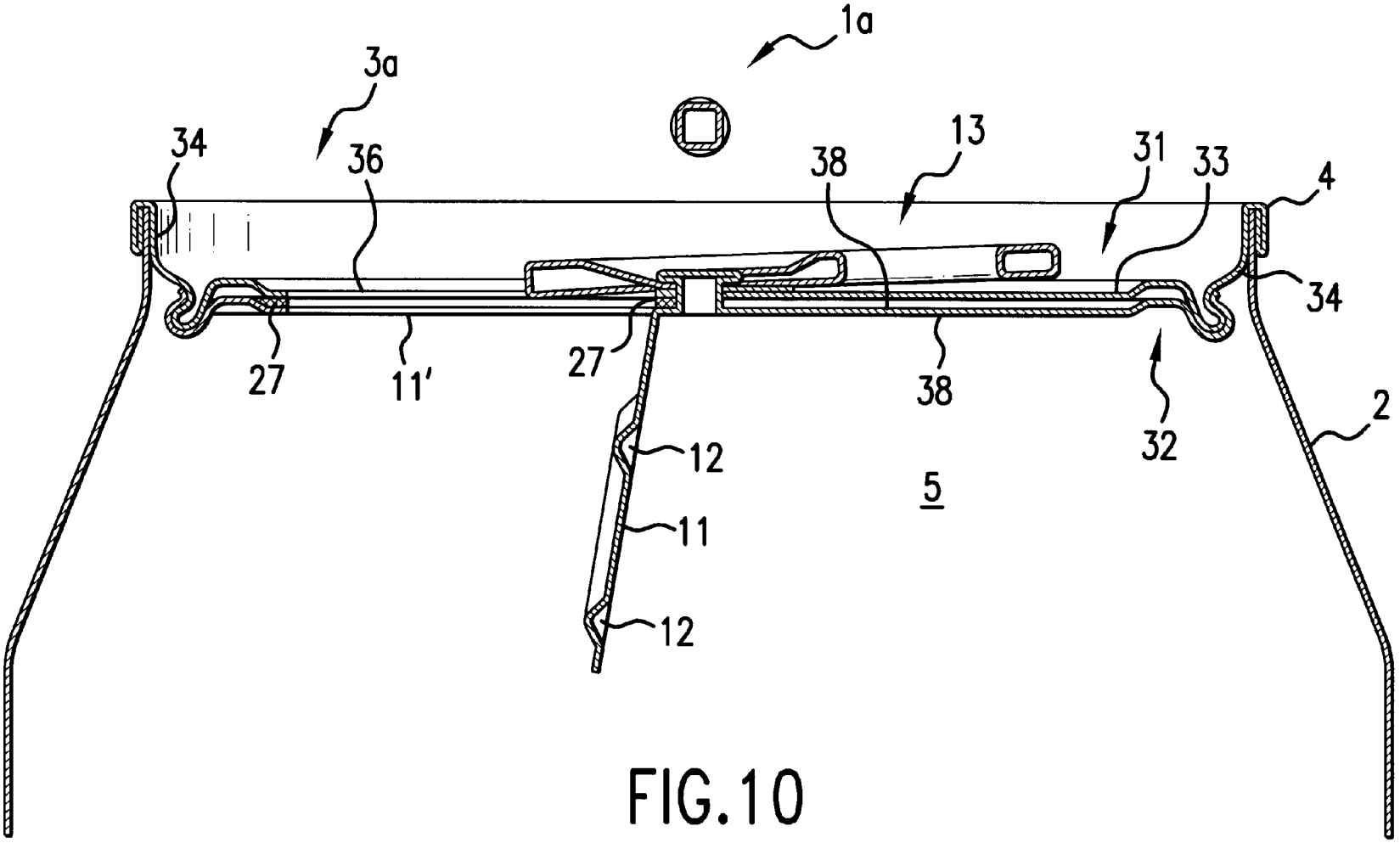
FIGS. 10 and 11 are sectional views through the beverage can in FIG. 9 in opened condition as well as through the working seal in closed condition.
Figure 11:
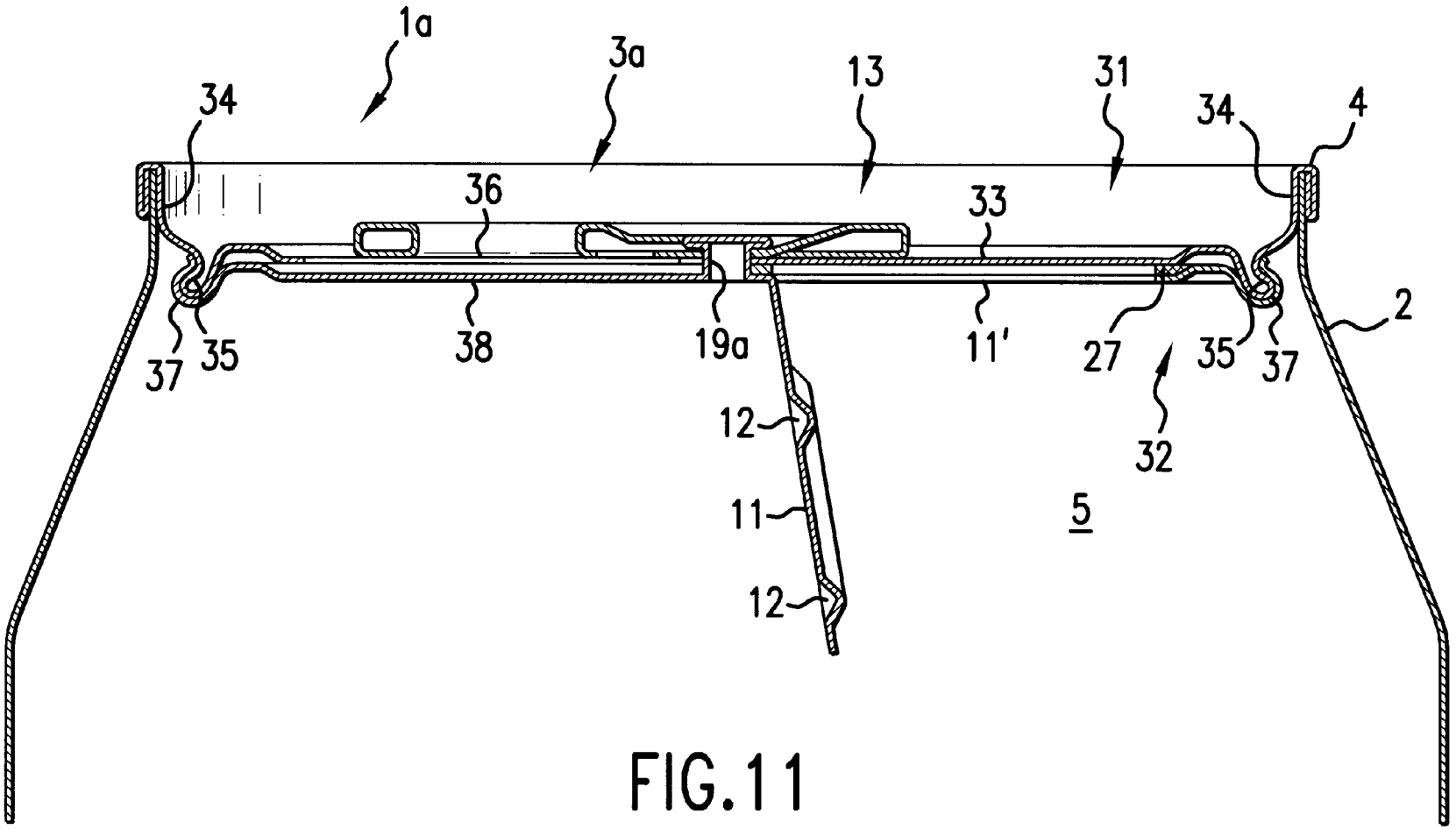

In order to open the beverage can 1*a*, the pull ring 13 is again lifted on the side opposite of the aperture 36 (Arrow A in FIG. 8); this causes the sealing tab 11 to be broken out through the aperture 36 and pressed into the interior 5 allowing the contents of the can to be removed through the congruent apertures 36 and 11' (FIG. 10). For the working seal, the lid element 32 can be turned by means of the pull ring 13 in such a way that the aperture 11' is sealed by the upper lid element 31, or its lid base 33.

In FIGS. 1 and 2, a surface 39 is provided for on the upper side of the lid element 6 or its base 7, is displaced in relation to the rotation axis of the lid element 20 (axis of the fastener 19) by 180° opposite the sealing tab 18. With the original seal of the beverage can 1 intact, this surface 39 is covered by the lid element 20 and not visible from the outside. Not until the beverage can is opened and the lid element 20 is unlocked can the latter be turned in such a way that the aperture 26 is congruent with the surface 39 and this is visible. The surface 39 can be used for the attachment or imprinting of information, pictures etc., for example for imprinting of ticket numbers or winning numbers, collective numbers, serial numbers, etc., that are not visible with the original beverage can 1*a* seal intact. In the same manner, a surface 39' is also possible for the beverage can la, in this case on the upper side of the can element 32 or the base 38 situated diametrically across from the tab 11 in relation to the rotation axis of this can element (axis of the fastener 19*a*). After opening of the original seal, the lid element 32 with the surface 39' can, in this embodiment again, be rotated in such a way that it is visible through the aperture 36.

Figure 12:
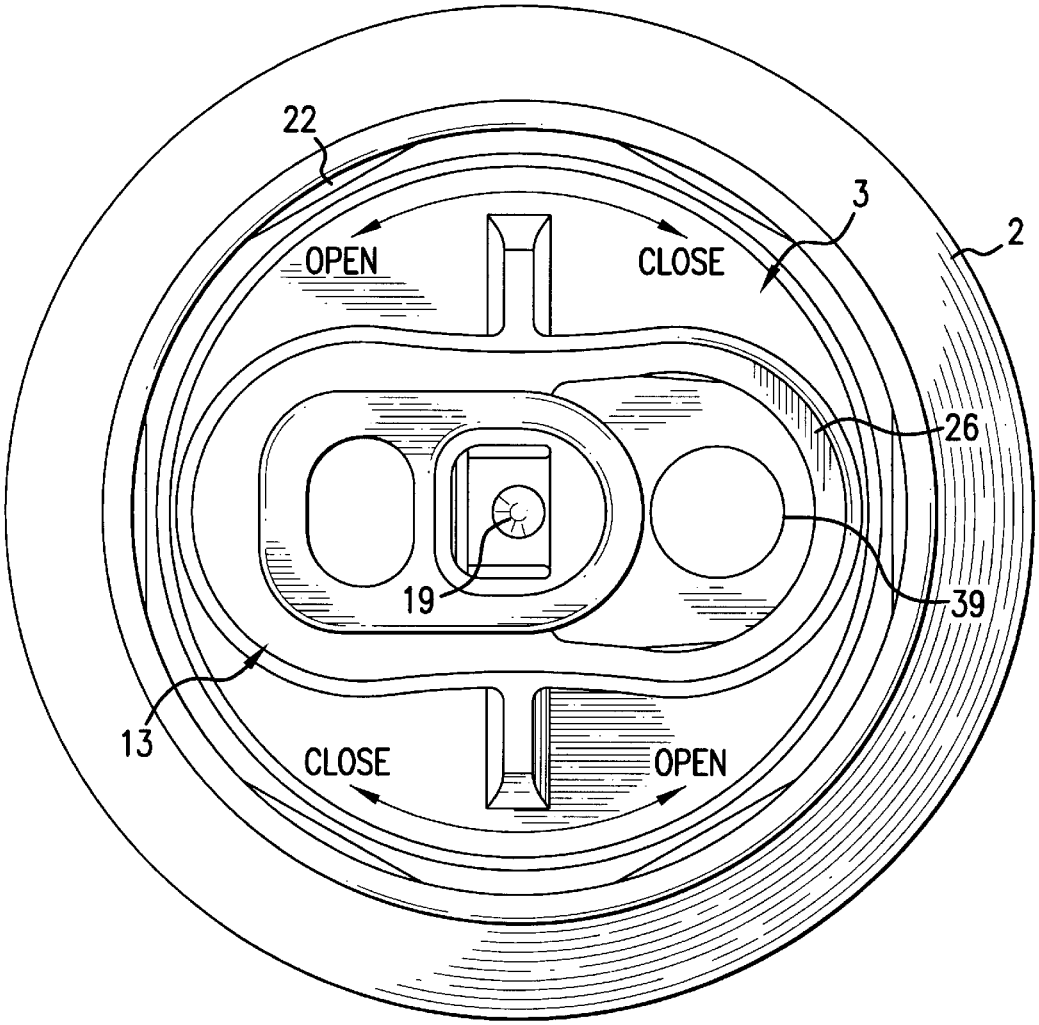
FIG. 12 is a view as in FIG. 3, however with a reclosed lid.
Figure 13:
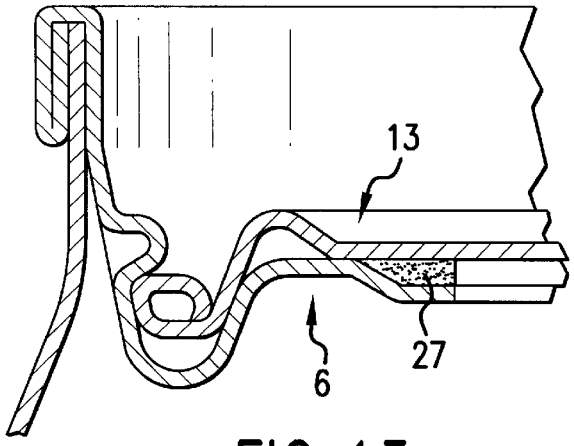
FIGS. 13–15 are enlarged sectional views of the lid elements of the can lid in the vicinity of the seals.
Figure 14:
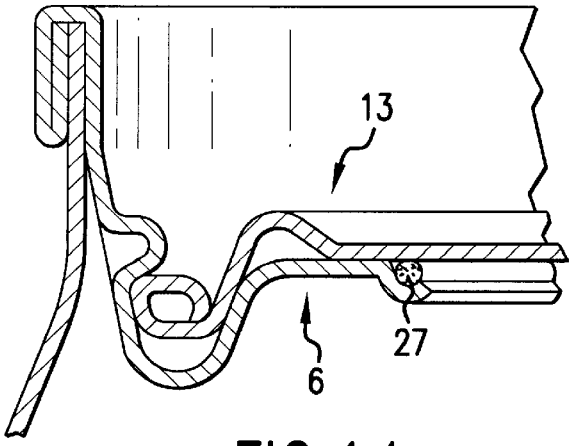
Figure 15:
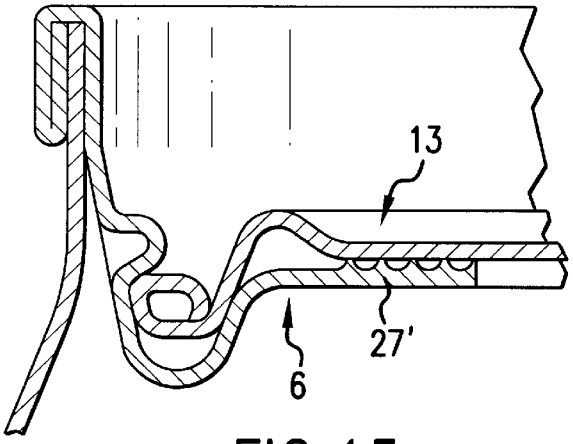

FIG. 12 shows, in a depiction similar to FIGS. 1 and 3, the lid 1 in resealed condition. In this position, the surface 39 is visible through the aperture 26. As shown in FIGS. 13 and 14, the seals 27, that are made of rubber or an appropriate, elastic plastic suitable for food, for example with a silicone-rubber base, can also be formed as seals with a circular ring-shaped cross section (FIG. 14) or as a lip or labyrinth seal (FIG. 13). The possibility remains to form the seals by suitable deforming of the material used for the respective can element directly from this material or from metal as metallic labyrinth seals, as shown by 27' in FIG. 15.

The invention was described above using examples of embodiments. Of course, numerous alterations and variations are possible without abandoning the inventive idea on which the invention is based.

List of reference symbols

| | |
|---|---|
| 1, 1a | beverage can |
| 2 | body of can |
| 3, 3a | lid of can |
| 4 | lock seam |
| 5 | interior |
| 6 | lid element |
| 7 | base |
| 8 | rim |
| 9 | snap ring groove |
| 10 | ring lip |
| 11 | sealing tab |
| 11' | aperture |
| 12 | lip |
| 13 | pull ring |
| 14 | ring body |
| 15 | middle stay |
| 16, 17 | ring aperture |
| 18 | tab |
| 19, 19a | fastener |
| 20 | lid element |
| 21 | rim lip |
| 22 | cam |
| 23 | base |
| 24 | rim |
| 25 | ring lip |
| 26 | aperture |
| 27, 27' | seal |
| 28 | carrier |
| 29, 30 | stop |
| 31, 32 | lid element |

-continued

List of reference symbols

| | |
|---|---|
| 33 | base |
| 34 | rim |
| 35 | ring lip |
| 36 | aperture |
| 37 | rim |
| 38 | base |
| 39, 39' | surface |

What is claimed is:

1. A container lid for a container, comprising a container body, the container lid that seals a container's interior has a sealing tab on a lid base, the tab can be at least partially removed for opening the container and freeing a container opening, the container lid is constructed of at least two parts with a first lid element and a second lid element, the first lid element contains the sealing tab, the second lid element has an aperture that has a distance from a middle axis of the lid which is the same as a distance of the sealing tab or the container opening, one of the first and second lid elements is affixed firmly and tightly to the container body, one of the two lid elements can be rotated on the middle axis in relation to the lid element that is affixed to the container body between a first position, in which the aperture is congruent with the sealing tab or the container opening, and a second position, in which the sealing tab or the container opening, is tightly sealed by the other respective lid element or its lid base, the lid element that can be rotated has a positive fit on its perimeter with the lid element that is affixed to the container body while being able to be rotated on the middle axis, and further comprising a rivet-like connector or fastener which allows for pivoting of the lid element that can be rotated.

2. The container lid according to claim 1, wherein the sealing tab extends into the second aperture, preventing the lid elements from rotating relative to each other when an original seal of the container lid is intact.

3. The container lid according to claim 1, wherein the lid element that can be rotated is of circular disk form.

4. The container lid according to claim 1, wherein the lid element that can be rotated is pivoted so that the element can rotate in an area of the middle axis of the lid on the lid element that is affixed to the container body.

5. The container lid according to claim 1, further comprising a seal encompassing the sealing tab or the container aperture that is provided between the first and second lid elements for sealing the container aperture.

6. The container lid according to claim 1, wherein the sealing tab is formed from a material of the lid element.

7. The container lid according to claim 1, wherein the sealing tab has a handle for pulling.

8. The container lid according to claim 1, wherein the sealing tab has a means for pressing the tab into the interior of the container in order to open the container.

9. The container lid according to claim 1, wherein the container lid has bowl-like form.

10. The container lid according to claim 1, wherein the first lid element contains a surface so that when the original container seal is intact and is covered by a second lid element, the surface is visible through the second aperture after rotating the first lid element relative to the second lid element.

11. The container having the container lid as claimed in claim 1.

12. The container lid according to claim 1, wherein an extension on the sealing tab extends into the second aperture, preventing the lid elements from rotating relative to each other when an original seal of the container lid is intact.

13. The container lid according to claim 1, wherein the sealing tab is formed from a material of the base that contains the sealing tab.

14. The container lid according to claim 1, further comprising means on the lid element that can be rotated for rotating the lid element.

15. The container lid according to claim 14, wherein the means for rotating the lid element is a ring.

16. The container lid according to claim 14, wherein the means for rotating the lid element are formed by at least one carrier provided for on the lid element that can be rotated.

17. The container lid according to claim 1, wherein a means for pressing or pulling the sealing tab is provided as a pivotal push-in or a pull ring.

18. The container lid according to claim 17, wherein the pull ring is held on the middle axis of the lid by a fastener.

19. A container lid for a container, comprising a container body the container lid that seals a container's interior has a sealing tab on a lid base, the tab can be at least partially removed for opening the container and freeing a container opening, the container lid is constructed of at least two parts with a first lid element and a second lid element, the first lid element contains the sealing tab, the second lid element has an aperture that has a distance from a middle axis of the lid which is the same as a distance of the sealing tab or the container opening, the first lid element is affixed firmly and tightly to the container body, the second lid elements can be rotated on the middle axis in relation to the first lid element between a first position, in which the aperture is congruent with the sealing tab or the container opening, and a second position, in which the sealing tab or the container opening, is tightly sealed by the other respective lid element or its lid base, the second lid element that can be rotated has a positive fit on its perimeter with the first lid element body while being able to be rotated on the middle axis, and the first lid element is formed with said lid base and with a rim, said extends beyond said lid base and beyond the second lid element neighbored to the base, the first lid element is affixed to the container body with said rim, and the positive fit of the second element on its perimeter with the first lid element is formed by cams which are pressed into the rim beyond an inner side of the rim facing the second lid element neighbored to the base.

20. The container having the container lid as claimed in claim 19.

21. A container lid for a container, comprising a container body the container lid that seals a container's interior has a sealing tab on a lid base, the tab can be at least partially removed for opening the container and freeing a container opening, the container lid is constructed of at least two parts with a first lid element and a second lid element, the first lid element contains the sealing tab, the second lid element has an aperture that has a distance from a middle axis of the lid which is the same as a distance of the sealing tab or the container opening, one of the first and second lid elements is affixed firmly and tightly to the container body, one of the two lid elements can be rotated on the middle axis in relation to the lid element that is affixed to the container body between a first position, in which the aperture is congruent with the sealing tab or the container opening, and a second position, in which the sealing tab or the container opening, is tightly sealed by the other respective lid element or its lid base, the lid element that can be rotated has a positive fit on its perimeter with the lid element that is affixed to the container body while being able to be rotated on the middle axis, and the second lid element is neighbored to a surface side of the lid base which faces the container interior and is connected to a pivotal push-in ring or a pivotal pull ring for being rotated with said ring, said push-in ring or pull ring being held on the middle axis of the lid and forming means for pressing or pulling the sealing tab into the interior of the container in order to open the container.

* * * * *